US010157698B2

(12) United States Patent
Nakamura et al.

(10) Patent No.: US 10,157,698 B2
(45) Date of Patent: Dec. 18, 2018

(54) METAL PLATE RESISTOR

(71) Applicant: KOA CORPORATION, Ina-shi, Nagano (JP)

(72) Inventors: Keishi Nakamura, Ina (JP); Kenji Kameko, Ina (JP)

(73) Assignee: KOA CORPORATION, Ina-shi, Nagano (JP)

( * ) Notice: Subject to any disclaimer, the term of this patent is extended or adjusted under 35 U.S.C. 154(b) by 44 days.

(21) Appl. No.: 15/301,578

(22) PCT Filed: Apr. 6, 2015

(86) PCT No.: PCT/JP2015/060734
§ 371 (c)(1),
(2) Date: Oct. 3, 2016

(87) PCT Pub. No.: WO2015/156247
PCT Pub. Date: Oct. 15, 2015

(65) Prior Publication Data

US 2017/0125142 A1 May 4, 2017

(30) Foreign Application Priority Data

Apr. 11, 2014 (JP) ..... 2014-081563

(51) Int. Cl.
*H01C 1/14* (2006.01)
*H01C 1/148* (2006.01)
(Continued)

(52) U.S. Cl.
CPC ..... *H01C 1/14* (2013.01); *H01C 1/148* (2013.01); *H01C 7/00* (2013.01); *H01C 13/00* (2013.01)

(58) Field of Classification Search
CPC ..... H01C 1/14; H01C 7/00; H01C 1/148; G01R 1/20
(Continued)

(56) References Cited

U.S. PATENT DOCUMENTS 5,382,938 A * 1/1995 Hansson ..... H01C 1/1406 338/114
2012/0229247 A1* 9/2012 Yoshioka ..... G01R 1/203 338/49
(Continued)

FOREIGN PATENT DOCUMENTS

DE 42 36 086 C1 12/1993
JP 1-123328 U 8/1989
(Continued)

OTHER PUBLICATIONS

International Search Report dated Jun. 16, 2015, issued in counterpart International Application No. PCT/JP2015/060734 (2 pages).

*Primary Examiner* — Kyung Lee
*Assistant Examiner* — Iman Malakooti
(74) *Attorney, Agent, or Firm* — Westerman, Hattori, Daniels & Adrian, LLP

(57) ABSTRACT

In a metal plate resistor, the bonded surface between the resistance body and the electrode can be prevented from peeling off. The metal plate resistor comprises a resistance body; an electrode consisting of metal material having a higher conductivity than the resistance body, and the electrode bonded with the resistance body; a recessed portion formed in an end face of the electrode on a side bonded with the resistance body; and a fixation hole formed in the electrode for inserting a bolt; wherein an end portion of the resistance body is fitted into the recessed portion in the electrode. The recessed portion is provided with wall portions on both sides in a width direction of the resistance body, and in a direction substantially perpendicular to a
(Continued)

penetration direction of the fixation hole. The recessed portion is opened to an end face and a first surface of the electrode.

2 Claims, 6 Drawing Sheets

(51) Int. Cl.
*H01C 13/00* (2006.01)
*H01C 7/00* (2006.01)

(58) Field of Classification Search
USPC ..... 338/49, 114, 322
See application file for complete search history.

(56) References Cited

U.S. PATENT DOCUMENTS

| | | | | |
|---|---|---|---|---|
| 2014/0097933 | A1 | 4/2014 | Yoshioka et al. | |
| 2015/0212115 | A1* | 7/2015 | Nakamura | G01R 1/203 338/332 |
| 2015/0226768 | A1* | 8/2015 | Nakamura | G01R 19/0092 324/126 |

FOREIGN PATENT DOCUMENTS

| | | | | |
|---|---|---|---|---|
| JP | 4-38808 | A | 2/1992 | |
| JP | 2008-182078 | A | 8/2008 | |
| JP | 2008182078 | * | 8/2008 | H01C 3/00 |
| JP | 2009-266977 | A | 11/2009 | |
| JP | 2011-3694 | A | 1/2011 | |
| JP | 2014-53437 | A | 3/2014 | |
| WO | 2013/005824 | A1 | 1/2013 | |

* cited by examiner

[FIG. 1]
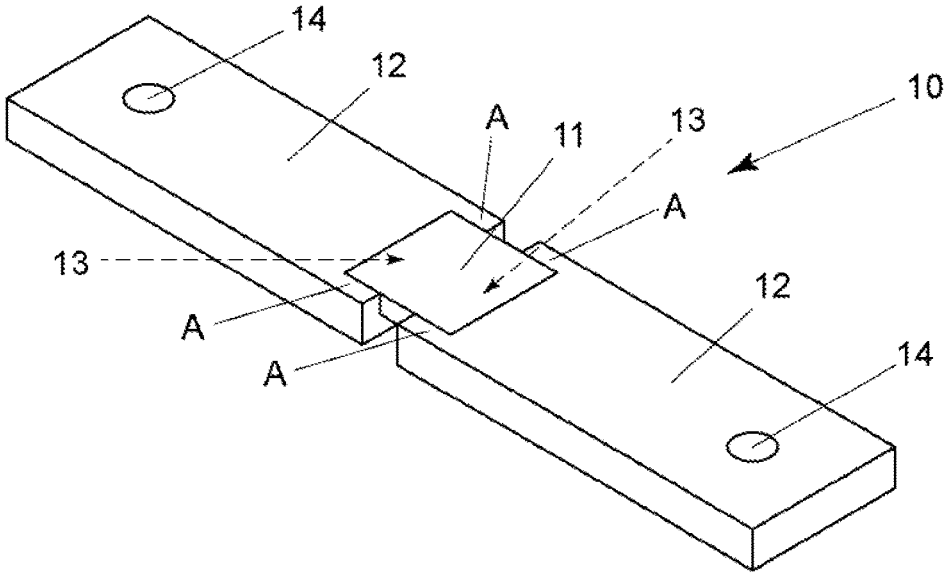
[FIG. 2]
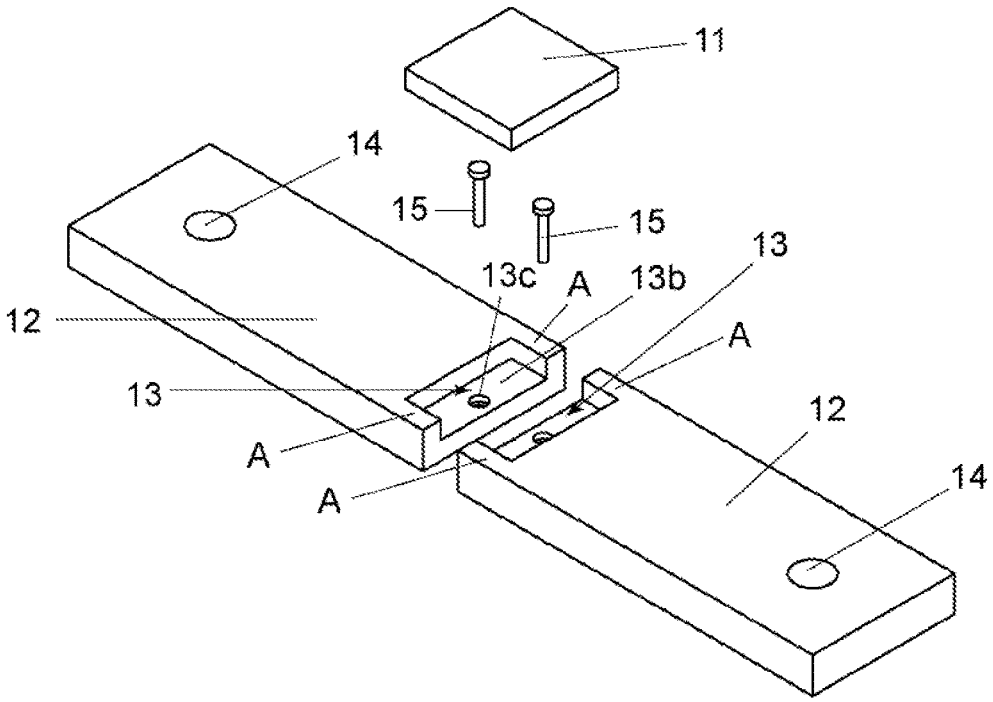

[FIG. 3]
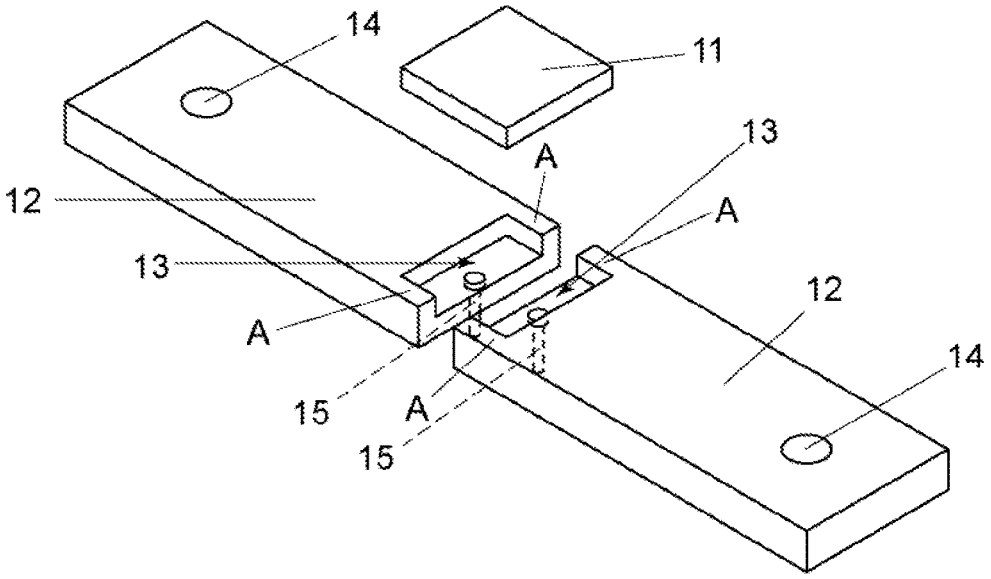
[FIG. 4]
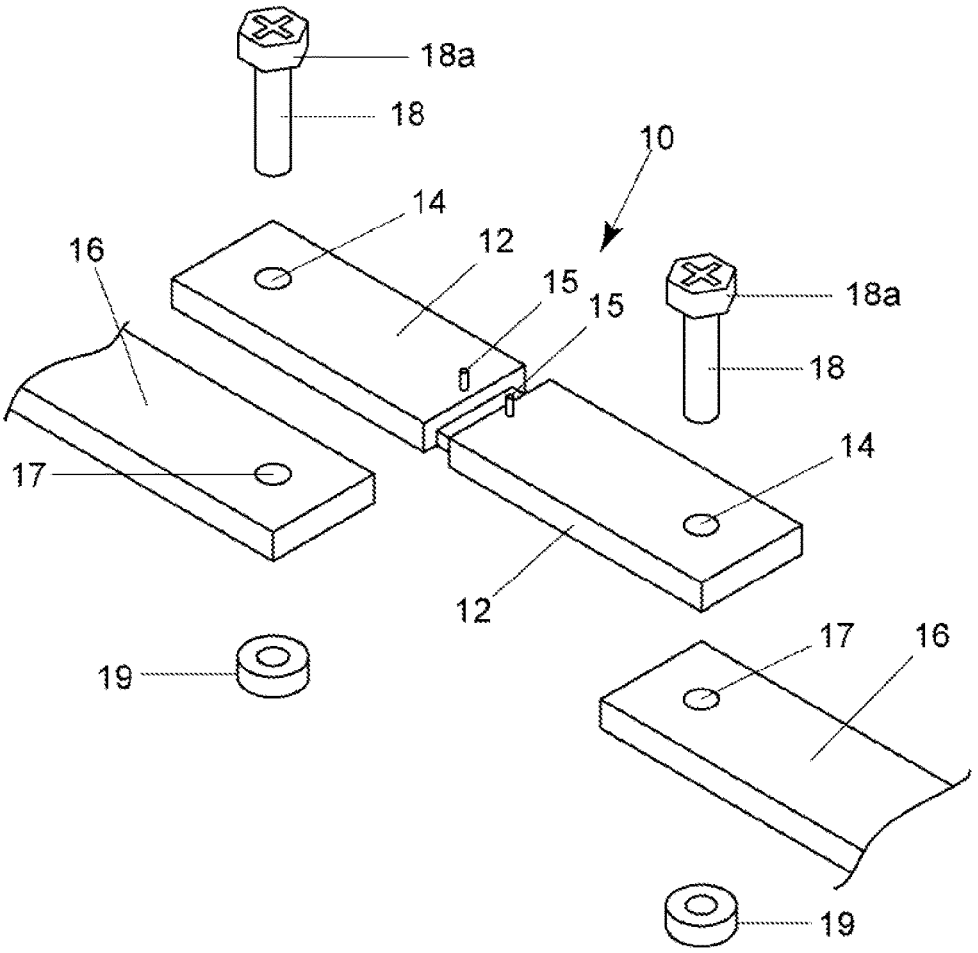

[FIG. 5]
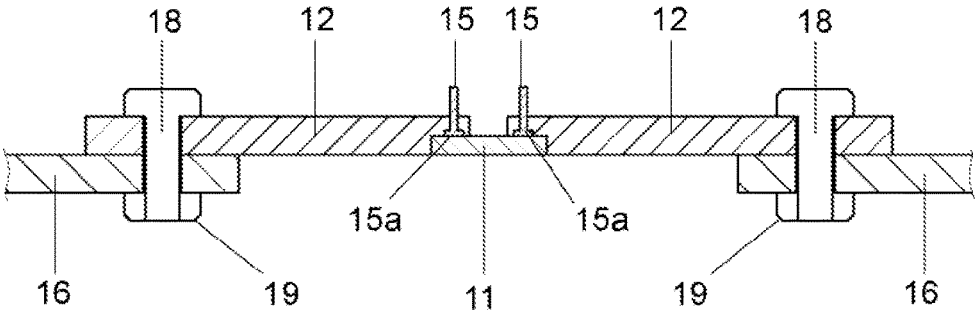
[FIG. 6]
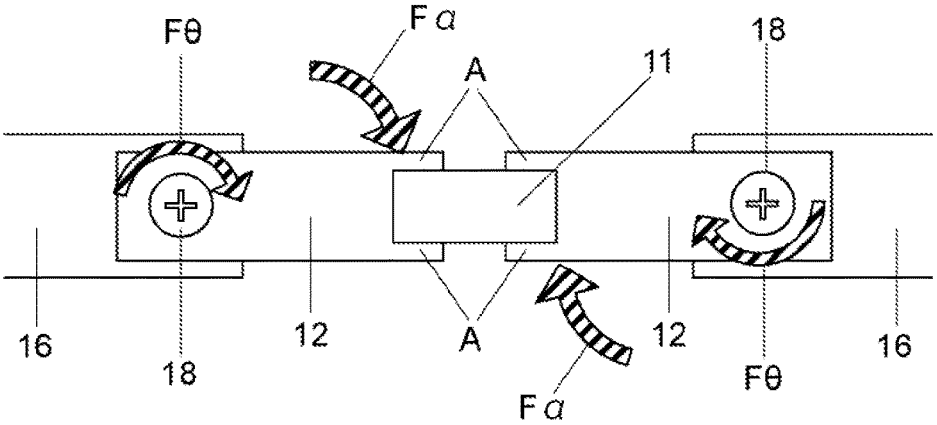
[FIG. 7]
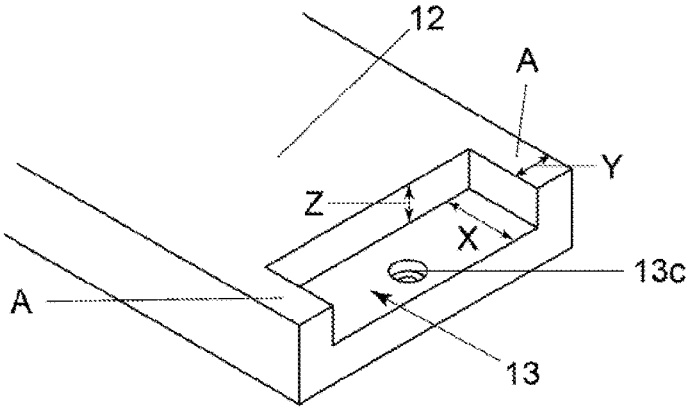

[FIG. 8]
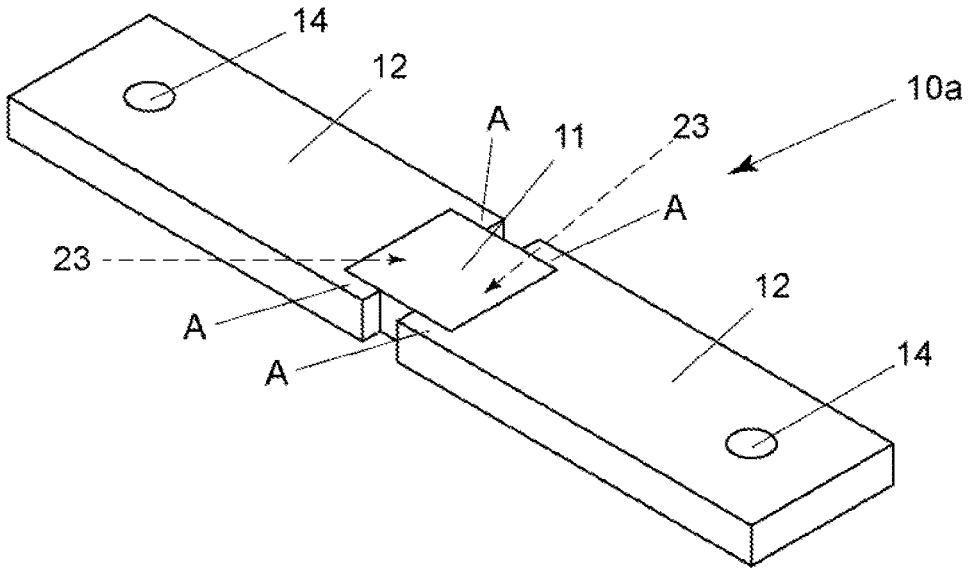
[FIG. 9]
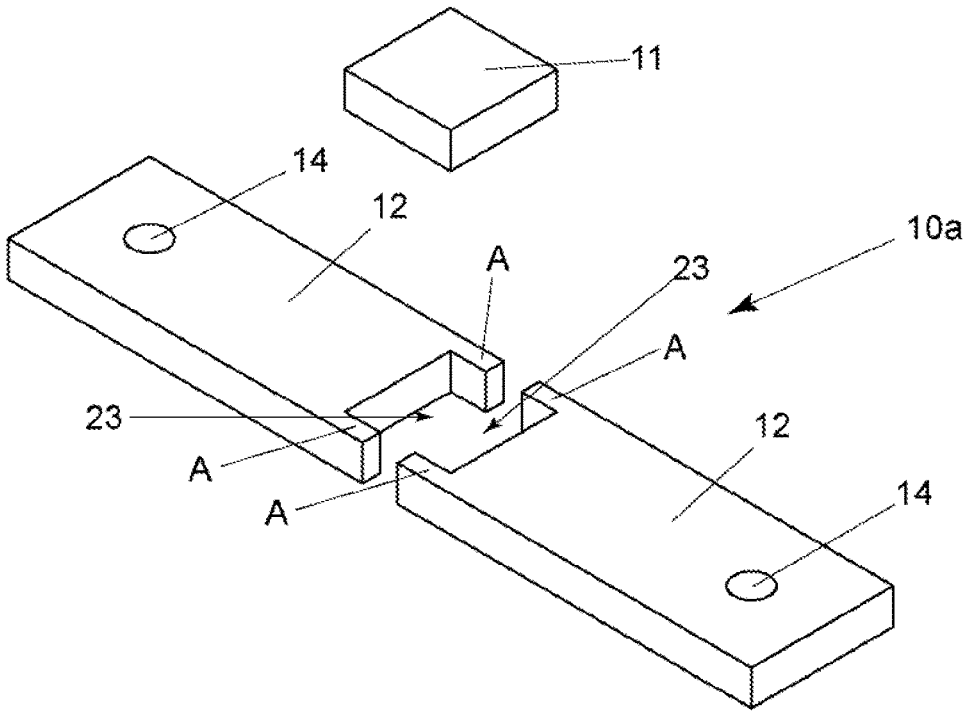

[FIG. 10]
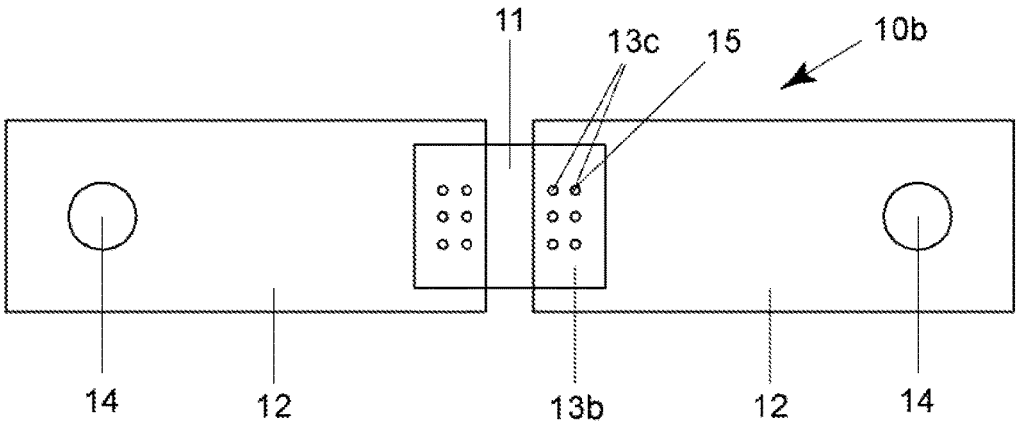
[FIG. 11]
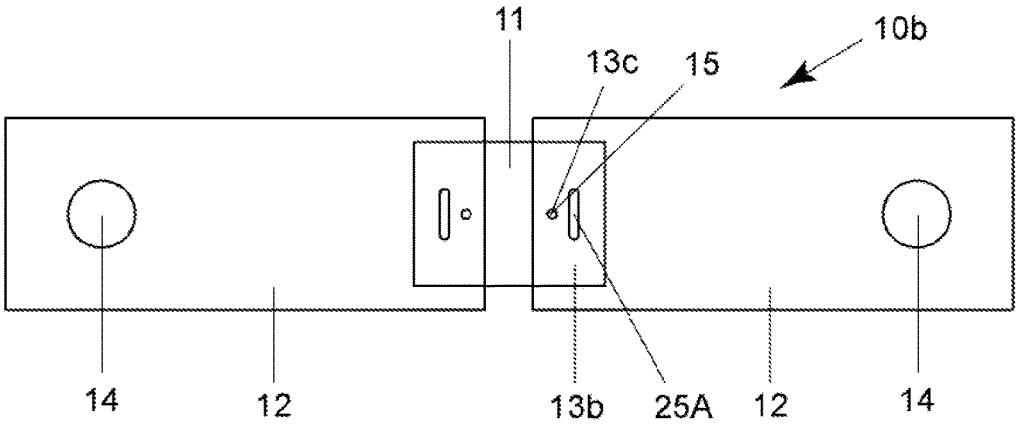

[FIG. 12]
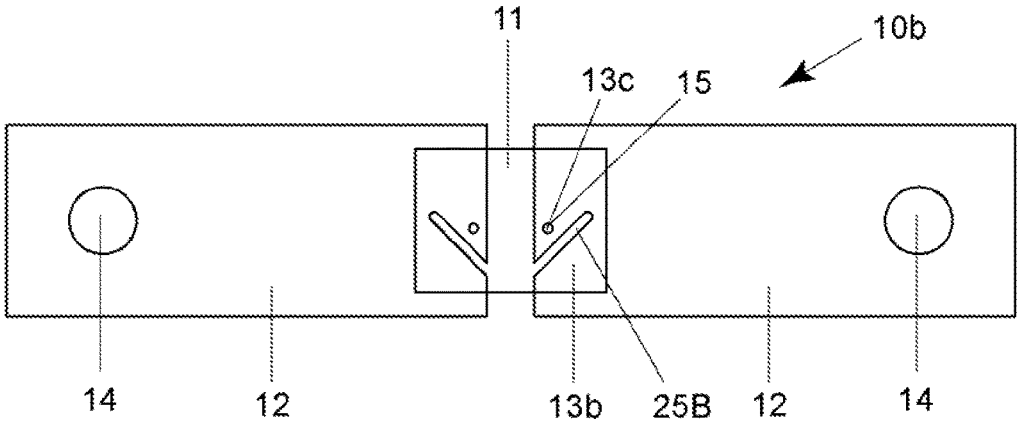
[FIG. 13]
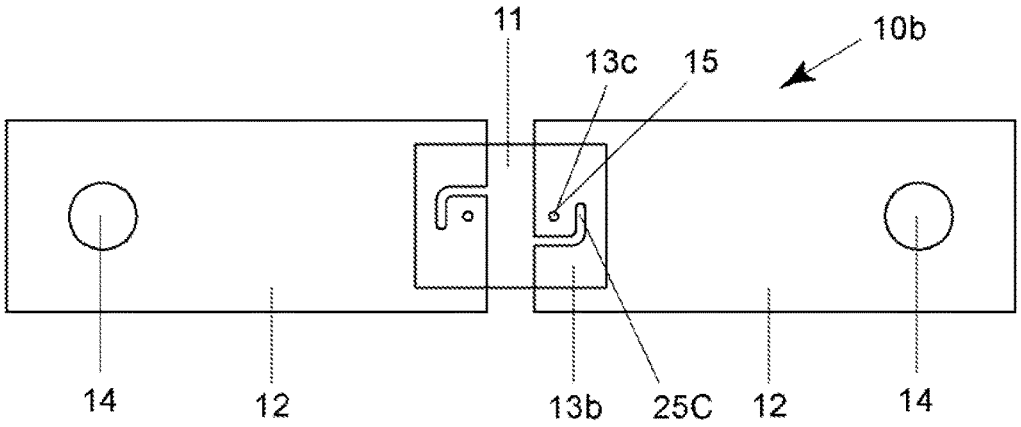

METAL PLATE RESISTOR

TECHNICAL FIELD

The present invention relates to a metal plate resistor, in which electrodes consisting of metal material are bonded to both ends of a resistance body consisting of metal material.

BACKGROUND ART

Metal plate resistors can detect large currents in high accuracy, and are used widely for detecting currents such as battery charge and discharge currents etc. In case of metal plate resistors when connecting to wire harness or bus bars, tightening a bolt is often used for these connections.

However, in case of connecting the resistors to a bus bar etc. by using tightening a bolt, if steps at a connection portion exist, the resistors are transformed into a shape to follow to the steps. Then the characteristics of the resistor may be affected to cause change and deterioration in reliability. Therefore a metal plate resistor, which has a deformation allowable portion when tightening a bolt, is proposed (see Japanese laid-open patent publication 2009-266977).

Also, when the metal plate resistor is connected to a bus bar etc. by tightening a bolt, a stress is generated around the bolt in direction of the bolt rotating. Then, the stress is applied to the bonded surface between the resistance body and the electrode in direction so that the surface is damaged and peeled off.

SUMMARY OF INVENTION

Technical Problem

The invention has been made basing on above-mentioned circumstances. Thus an object of the invention is to provide a metal plate resistor, which can suppress the stress applied to the bonded surface between the resistance body and the electrode so that the bonded surface can be prevented from peeling off, when connecting the metal plate resistor to a bus bar or the like by tightening a bolt.

Solution to Problem

The metal plate resistor comprises a resistance body consisting of metal material; an electrode consisting of metal material having a higher conductivity than the resistance body, and the electrode bonded with the resistance body; a recessed portion formed in an end face of the electrode on a side bonded with the resistance body; and a fixation hole formed in the electrode for inserting a bolt; wherein an end portion of the resistance body is fitted into the recessed portion in the electrode.

The recessed portion is provided with wall portions on both sides in a width direction of the resistance body and in a direction substantially perpendicular to a penetration direction of the fixation hole. The recessed portion is opened to an end face and a first surface of the electrode. The recessed portion has a bottom surface, which is provided with a terminal hole for inserting a voltage detection terminal penetrating from the first surface to the second surface opposite to the first surface. The terminal is flange-shaped so that an end thereof contacts to the bottom surface.

BRIEF DESCRIPTION OF DRAWINGS

FIG. 1 is a perspective view of the resistor of first embodiment of the invention.

FIG. 2 is an exploded perspective view of the resistor before installing voltage detection terminals.

FIG. 3 is an exploded perspective view of the resistor after installing voltage detection terminals.

FIG. 4 is an exploded perspective view of the re star at the step of mounting the resistor to a bus bar.

FIG. 5 is a perspective view of the resistor after mounting the resistor to a bus bar.

FIG. 6 is an explanatory view of the resistor for illustrating an effect of the invention.

FIG. 7 is a perspective view for showing dimensions of the recessed portion.

FIG. 8 is a perspective view of the resistor of second embodiment of the invention.

FIG. 9 is an exploded perspective view of the resistor of second embodiment of the invention.

FIG. 10 is a plan view of the resistor of third embodiment of the invention.

FIG. 11 is a plan view of the resistor of fourth embodiment of the invention.

FIG. 12 is a plan view of a variation of the resistor of fourth embodiment.

FIG. 13 is a plan view of another variation of the resistor of fourth embodiment.

DESCRIPTION OF EMBODIMENTS

Embodiments of the invention will be described below with referring to FIG. 1 through FIG. 13. Like or corresponding parts or elements will be denoted and explained by same reference characters throughout views.

FIG. 1 shows a metal plate resistor of first embodiment of the invention. The resistor 10 is provided with a plate shaped resistance body 11 consisting of metal material such as Cu—Mn—Ni system alloy and a pair of plate shaped electrodes 1212 consisting of metal material such as Cu, which has higher conductivity than the resistance body. An end face of the resistance body 11 and an end face of the electrode 12 are bonded by welding or pressure bonding etc. to form a metal plate resistor for a current detection.

The resistor 10 is provided with recessed portions 13 formed on end faces of the electrodes 12, which are bonded with the resistance body (see FIGS. 2-3). Both end portions of the resistance body 11 are fitted and bonded into the recessed portions on the electrodes. Further, the electrodes 12 are provided with holes 14 for inserting bolts so as to enable to connect the resistor to bus bars etc. by tightening the bolts.

The recessed portion 13 is opened to a first surface (top surface) and an end face of the electrode 12. The recessed portion 13 is provided with wall portions A on both sides in a width direction of the resistance body 11, and in a direction substantially perpendicular to a penetration direction of the fixation hole 14. According to make an end portion of the resistance body 11 fitting into the recessed portion 13 of the electrode, bonding between the resistance body and the electrode becomes lengthened against the stress caused by tightening the bolt. That is, according to the wall portions A, the end portion of resistance body 11 can be supported by both sides against the stress of rotation direction of the bolt. Therefore, when tightening the bolt, the stress applied to the bonded surface between the resistance body and the electrode can be decreased, and it becomes difficult for the bonded surface to peel off.

FIG. 2 shows an exploded perspective view of the resistor itself. The recessed portion 13 is formed in the end face of the electrode on a side bonded with the resistance body. The recessed portion provided with wall portions A on both sides in a width direction of the resistance body, another wall portion at an end of the recessed portion in length direction, and a bottom portion 13*b* surrounded by the wall portions A and the another gall portion. The end portion of the resistance body 11 is fitted into the recessed portion 13 and bonded to the bottom portion 13*b*, the wall portions A on both sides, and the another wall portion at an end face by welding or pressure bonding etc.

Brazing and soldering can be used by coating Cu wax, Ag wax etc. in the recessed portion 13, fitting the end portion of the resistance body, and heating and cooling so that surfaces of the resistance body and the electrode are bonded by the wax. Welding can be made by using laser beam welding, electron beam welding etc., and bonding surfaces between the resistance body and the electrode.

A terminal hole 13*c* is formed in bottom surface 13*b* of recessed portion 13 penetrating through from the first surface (top surface) to the second surface (back surface). A voltage detection terminal 15 can be inserted therethrough projecting to the second surface (back surface) side. Therefore, the voltage detection terminal 15 can be easily fixed projecting to the second surface (back surface) side. Further, by changing a position of the terminal hole 13*c*, that is, changing a position of the voltage detection terminal 15, voltage detection accuracy can be improved. For example, making a position of the terminal; hole 13*c* in the electrode to close to an, end face of resistance body side and making the voltage detection terminal 15 to close to an end face of resistance body side, a voltage detection decreasing effects of resistance components in the electrode becomes possible.

The voltage detection terminal 15 is preferable to be flange-shaped so that an end of the terminal contacts to bottom surface portion 13*b*. Therefore, positioning of the terminal 15 becomes easy and prevention of omission of the terminal becomes possible. FIG. 3 shows a state that the terminal 15 has been installed into terminal hole 13*c*. Terminal hole 13*c* has a recessed portion, which engages flange portion of the terminal 15 so that top of flange portion of the terminal 15 becomes flat to bottom surface 13*c* after installation of the terminal 15 (see FIG. 5). Bottom portion 13*b*, which becomes flat after installation of the terminal 15, is covered with end portion of the resistance body 11 and fixed by welding or blazing etc. Then omission or withdrawing of the terminal 15 can be prevented. In the step, the terminal 15 projects to the second surface (back surface) side.

FIG. 4 shows an exploded perspective view of mounting the metal plate resistor to bus bars. Back surface side of metal plate resistor in FIG. 1 is shown to be top surface side. The terminal 15 is projected on the electrode 12 near end face of resistance body side so that a voltage caused by a current flowing through the resistance body 11 is detected and taken away to outside. A bolt 18 is inserted through fixation hole 14 in electrode 12 and fixation hole 17 in bus bar 16. By tightening the bolt 18 with the nut 9 the electrode 12 of the resistor is connected to the bus bar 16.

FIG. 5 shows a state that the electrode 12 of the resistor has been mounted to the bus bar 16 by tightening the bolt 18 with the nut 19. That both ends of the resistance body 11 is fitted into the recessed portions formed at end face portions of the electrodes 12 and bonded to be fixed by blazing or welding etc. Because the resistance body is also bonded to be fixed with bottom surface portion 13*b* of the recessed portion 13, the metal plate resistor is strong against stresses in vertical direction in the figure. A pair of the terminal 15 is projected to the second surface side of the electrodes while contacting its flange portions to the resistance body 11.

FIG. 6 shows a distribution of stresses generated when mounting shown in FIG. 4. When the bolt 18 is tightened in direction of rotation, a stress is generated in direction of rotation shown as Fθ. Accordingly a stress Fα is generated in vertical direction to length direction of the resistance body at vicinity of bonded surface between the resistance body 11 and the electrode 12. Because the recessed portion 13 in the electrode 12 is provided with the wall portions A on both sides in a width direction of the resistance body 11, the wall portions A can support the end portions of the resistance body 11 by both sides against the stress Fθ in direction of rotation of the bolt 18. Therefore, the stress Fα generated when tightening the bolt 18 does not apply to the bonded surface between the resistance body 11 and the electrode 12. Thus, when tightening the bolt 18, the possibility that the bonded surface between the resistance body 11 and the electrode 12 peels off disappears, and then the reliability of the metal plate resistor can be improved.

FIG. 7 shows regarding to preferable dimensions of the recessed portion 13. The length X of the recessed portion 13 is preferably from half to twice of thickness of the resistance body 11. The width Y of the wall portion A is preferably more than half of thickness of the resistance body. The height Z of the recessed portion 13 is preferably more than half of thickness of the resistance body 11. These dimensions should be determined to be suitable for the support by the wall portions A so that the stress $F_\alpha$ generated when tightening the bolt 18 does not affect to the bonded surfaces between the resistance body 11 and the electrode 12.

FIGS. 8 and 9 show a metal plate resistor 10*a* of second embodiment of the invention. In the embodiment, the recessed portion 23 penetrates between the first surface and the second surface of the electrode, and does not have the bottom portion. That is, thickness of the resistance body 11 is equal to thickness of the electrode 12, and the recessed portion 23 is provided with a pair of wall portions A on both sides in a direction substantially perpendicular to a penetration direction of the fixation hole 14 and in a width direction of the resistance body 11.

Accordingly, both end portions of the resistance body 11 are supported by a pair of wall portions A of the recessed portion 23, and stronger structure against the stress caused by tightening the bolt can be obtained. Because the recessed portion 23 penetrates between the first surface and the second surface of the electrode, positioning of the resistance body becomes easy. The bonded surface of the resistance body 11 and the electrode 12 is formed by blazing, or welding etc. as well as the first embodiment.

FIG. 10 shows a metal plate resistor 10*b* of third embodiment of the invention. In the embodiment, a plural of holes 13*c* for inserting voltage detection terminal 15 is formed on the bottom surface 13*b* of the recessed portion 13. Accordingly, the voltage detection terminal 15 can be projected by inserting the terminal 15 into any one of the plural of holes 13*c*. According to best position of the terminal 15, the current can be detected at most appropriate position corresponding to the current distribution. As a result, it becomes possible to adjust the TCR characteristic etc. of the metal plate resistor. In the development phase, characteristics may be examined to find the best position by using the plural holes of the embodiment, and in the commercial product phase, the hole may be formed only at a best position.

FIGS. 11-13 shows a metal plate resistor of fourth embodiment of the invention. In the embodiment, a singular hole 13*c* is formed on the bottom surface 13*b* in the recessed portion 13, and the voltage detection terminal 15 is inserted therein. Line-shaped holes 25A, 25B, 25C, which penetrates between first surface and second surface of the electrode, is formed at vicinity of the hole 13*c* for stopping flow of the current at vicinity of the hole 13*c*. In FIG. 11, the hole 25A is formed in direction perpendicular to current flow direction. In FIG. 12, the hole 25B is formed in direction slantingly extending from end face of the electrode of resistance body side. In FIG. 13, the hole 25C is formed extending from end face of the electrode of resistance body side in direction of current flow direction and turning to direction perpendicular to current flow direction, like L-shaped.

According to line-shaped penetrating holes 25A 25B, 25C, which are formed at outside (electrode side) of the voltage detection terminal 15, the current can be made not to flow at vicinity of the terminal 15. Then, effects of resistance components of the electrode can be decreased, and more accurate current detection becomes possible. Further, it becomes possible to adjust the TCR characteristics etc. of the metal plate resistor.

Although embodiments of the invention have been explained however the invention is not limited to above embodiments, and various changes and modifications may be made within scope of the technical concepts of the invention.

INDUSTRIAL APPLICABILITY

The invention can be suitably used for metal plate resistors, which can be connected to bus bars etc. by tightening a bolt.

The invention claimed is:

1. A metal plate resistor comprising:

a resistance body consisting of metal material;

an electrode consisting of metal material having a higher conductivity than the resistance body, and the electrode bonded with the resistance body;

a recessed portion formed in an end face of the electrode on a side bonded with the resistance body; and a fixation hole formed in the electrode for inserting a bolt;

wherein an end portion of the resistance body is fitted into to the recessed portion in the electrode;

wherein the recessed portion is provided with wall portions on both sides in a width direction of the resistance body, and in a direction substantially perpendicular to a penetration direction of the fixation hole;

wherein the recessed portion is opened to an end face and a first surface of the electrode; and wherein the recessed portion has a bottom surface, which is provided with a voltage detection terminal hole, which penetrates from the first surface to the second surface opposite to the first surface.

2. The metal plate resistor of claim 1, wherein a voltage detection terminal is flange-shaped so that an end thereof contacts to the bottom surface.

* * * * *